US005180279A

United States Patent [19]

McLane-Goetz et al.

[11] Patent Number: 5,180,279

[45] Date of Patent: Jan. 19, 1993

[54] HEAT SHIELD AND DEFLECTOR FOR ENGINE COOLING FAN MOTOR

[75] Inventors: Lee A. M. McLane-Goetz, Mt. Clemens, Mich.; Matthew J. Laramie, Apache Junction, Ariz.; Kevin L. McClelland, Mesa, Ariz.; Robert L. McCormick, Mesa, Ariz.; Allen L. Schultz, Mesa, Ariz.

[73] Assignee: General Motors Corporation, Detroit, Mich.

[21] Appl. No.: 861,222

[22] Filed: Mar. 31, 1992

[51] Int. Cl.[5] ..... F01D 5/08

[52] U.S. Cl. ..... 415/177; 415/178; 415/175; 165/135

[58] Field of Search ..... 415/177, 178, 175, 176; 416/169 A; 165/135

[56] References Cited

U.S. PATENT DOCUMENTS

| | | | |
|---|---|---|---|
| 2,234,792 | 3/1941 | Allen | 415/175 |
| 2,354,128 | 7/1944 | Lake et al. | 415/178 |
| 2,365,991 | 12/1944 | Shoults | 415/178 |
| 2,888,878 | 6/1959 | Cobb | 415/177 |
| 3,819,294 | 6/1974 | Honnold et al. | 416/93 |
| 4,805,868 | 2/1989 | Claude | 248/603 |
| 4,969,421 | 11/1990 | Häner et al. | 123/41.49 |

*Primary Examiner*—John T. Kwon
*Assistant Examiner*—Mark Sgantzos
*Attorney, Agent, or Firm*—A. Michael Tucker

[57] ABSTRACT

A cover plate for a cooling fan motor includes a heat shield portion spaced from the motor and a deflector portion extending beyond the motor. The deflector portion redirects axial discharge airflow across the motor to provide cooling, thereby improving the life of the motor bearings and the operating efficiency of the motor.

20 Claims, 2 Drawing Sheets

HEAT SHIELD AND DEFLECTOR FOR ENGINE COOLING FAN MOTOR

BACKGROUND OF THE INVENTION

1. Field of the Invention

The present invention relates generally to engine cooling fan assemblies, and in particular is concerned with a heat shield and deflector for preventing overheating of an electric fan motor.

2. Description of the Related Art

Electric motors for rotating cooling fans in vehicular engine compartments are well-known. Generally, a cooling fan is mounted by a bracket adjacent an engine coolant radiator to pump a cooling airflow through the radiator. An electric motor mounted on a hub of the bracket drives the fan. The control of the motor and the fan can be accomplished by any suitable manner. Oftentimes, a shroud is used in combination with a fan to increase the cooling efficiency.

Underhood temperatures may reach levels which impair bearings housed in electric motors. Particularly when an electric motor is mounted on the rear side of the radiator in an engine compartment with a transversely mounted engine, radiant heat from the engine and its exhaust manifolds can reach temperatures which adversely affect motor bearings. This condition is heightened when the spacing between the electric motor and an exhaust manifold is minimal, as may be found in modern vehicles.

Heat shields for reducing the amount of radiant heat encountering electric cooling fan motors are known. However, it is desirable to provide additional cooling to improve the life of bearings in and the operating efficiencies of electric motors.

SUMMARY OF THE INVENTION

The present invention includes a cover plate for a cooling fan motor. The cover plate includes a deflector for directing exiting airflow from a cooling fan across the fan motor to provide improved cooling for the motor and its bearings. The cover plate and deflector are economical to manufacture and can be used with conventional cooling fan assemblies.

In a preferred embodiment, a cover plate for a cooling fan motor includes a heat shield portion spaced from the motor and a deflector portion extending beyond the motor. The deflector portion redirects axial discharge airflow across the motor to provide cooling, thereby improving the life of the motor bearings and the operating efficiency of the motor.

DETAILED DESCRIPTION OF THE PREFERRED EMBODIMENT

Figure 1:
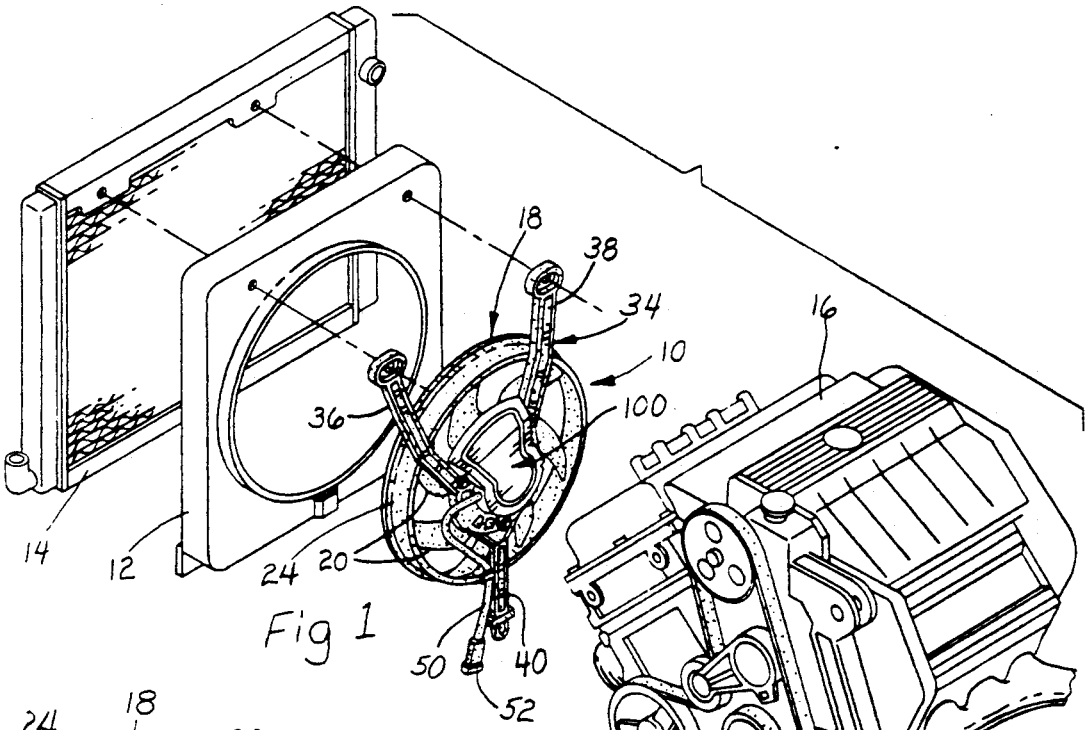
FIG. 1 is an exploded perspective view illustrating a radiator, a shroud, a cooling fan assembly incorporating the present heat shield and deflector, and a transversely oriented engine.

A cooling fan assembly indicated generally at 10 is illustrated in FIG. 1. The assembly 10 is mounted on a shroud 12 which is positioned at a rear side of a radiator 14. In another embodiment, the shroud 12 may be eliminated so that the cooling fan assembly 10 is attached to the radiator 14. Also, a shroud can be integrally formed with the cooling fan assembly 10 if desired. An automotive internal combustion engine 16 illustrated in a transverse orientation is placed near the cooling fan assembly 10 in a typical engine compartment of a vehicle. The cooling fan assembly 10 draws cooling air through the radiator 14 and is subject to the elevated temperatures of the engine compartment.

The cooling fan assembly 10 includes a fan 18 having a plurality of rotating blades 20 and a central hub 22. A rotating ring shroud 24 is connected to radial outermost portions of the blades 20. Preferably, the fan 18 is molded from a plastic material.

An output shaft (not illustrated) of an electric motor 26 is drivingly connected to the hub 22 by a nut 28 in a well-known manner. The electric motor 26 is secured within an annular opening 30 in a central portion of a multi-legged fan bracket 34, preferable molded from a plastic material. In the embodiment of the figures, three legs 36,38,40 are illustrated. Mounting brackets 42,44 provided on an outer housing of the electric motor 26 are secured by respective fasteners 46,48 to the fan bracket 34. The electric motor 26 can be any suitable dynamoelectric machine and includes well-known rotor, stator, and bearing components. A wire 50 delivers electric current to the electric motor 26 and terminates in a connector 52 for easy installation with the electrical system of a vehicle.

A cover plate indicated generally at 100 is secured to the fan bracket 34 and provides protection of the electric motor 26 from high temperatures in the engine compartment. The embodiment illustrated in the figures includes three mounting tabs 102,104,106, each of which includes a central opening 108,110,112 for receiving a fastener 114,116,118 threaded to complementary openings in the fan bracket 34.

The cover plate 100 includes a generally circular heat shield portion 120 having a diameter preferably at least as great as the diameter of the electric motor 26. When the cover plate 100 is mounted on the fan bracket 34, the heat shield portion 120 is spaced a predetermined distance from the electric motor 26 so that air may flow between the head shield portion 120 and the electric motor 26 as described below. The heat shield portion 120 acts as a barrier to radiant heat from the engine compartment that would otherwise reach the electric motor 26.

Figure 3:
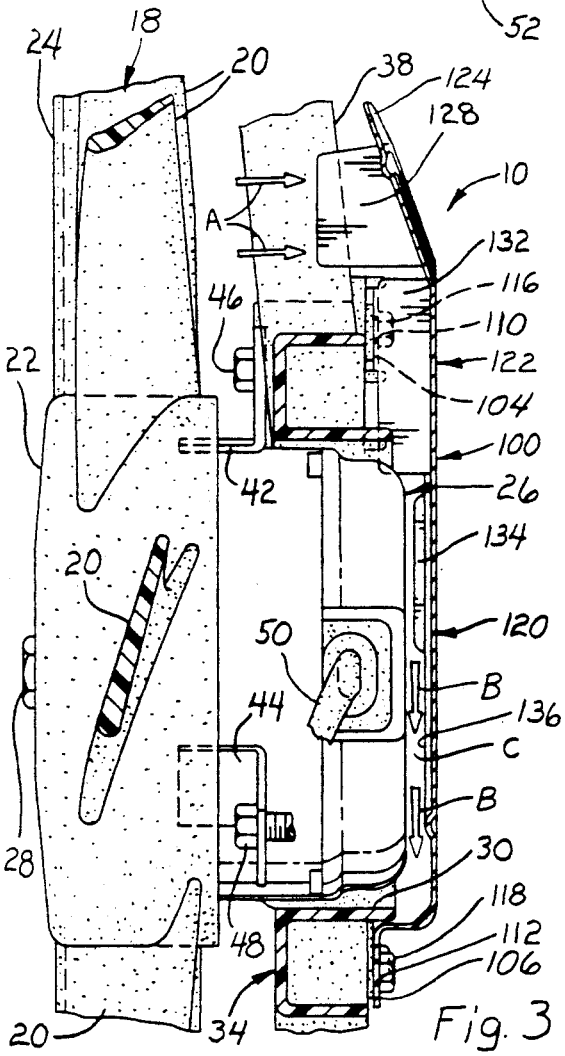
FIG. 3 is an enlarged sectional view taken along line 3—3 of FIG. 2 illustrating the deflection of exiting airflow from the cooling fan across a rear surface of the electric motor.
Figure 4:
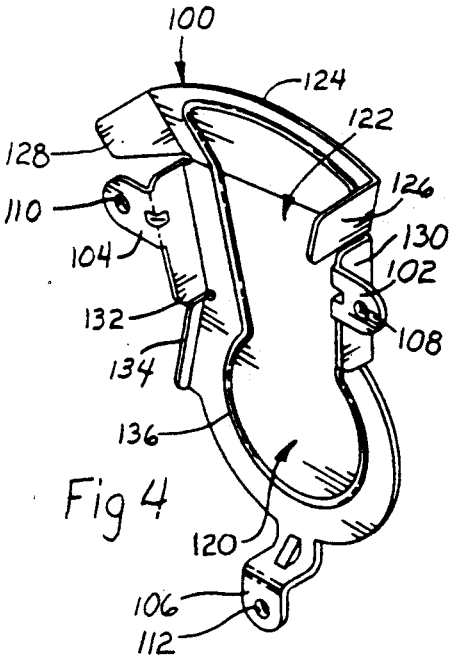
FIG. 4 is a perspective view of the present heat shield and deflector removed from the cooling fan assembly.
Figure 2:
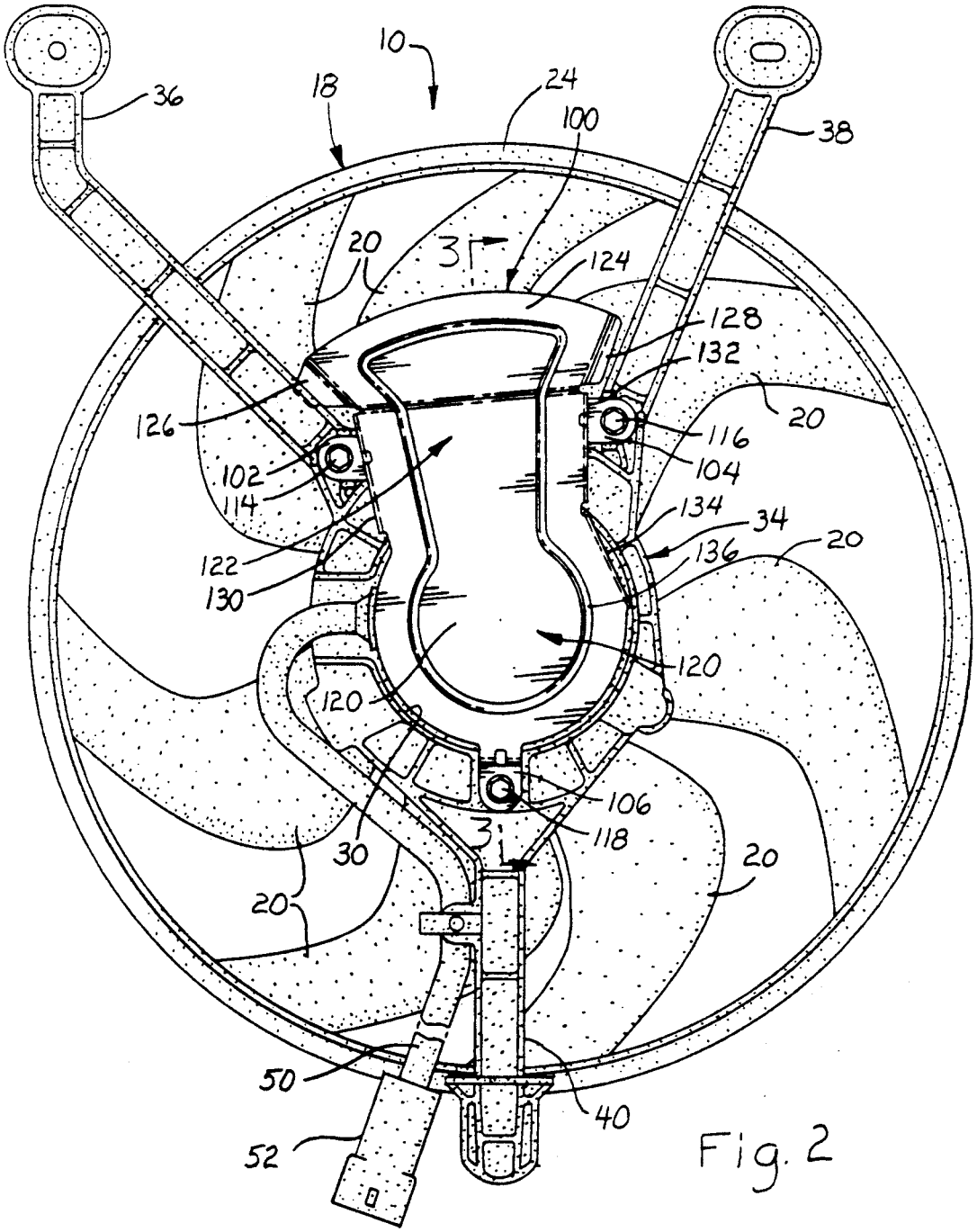
FIG. 2 is a rear elevational view of the cooling fan assembly of FIG. 1 illustrating the heat shield and deflector fastened to a fan bracket.

The cover plate 100 also includes a deflector or air scoop portion 122 extending a predetermined distance beyond the diameter of the electric motor 26. The deflector portion 122 preferably extends a radial distance to deflect exiting airflow from the blades 20 of the fan 18 to the space provided between the heat shield portion 120 and the electric motor 26. As illustrated in FIG. 3, substantially axial exiting airflow indicated by arrows A encounters the deflector portion 122 and is redirected to substantially perpendicular airflow indicated by arrows B across the rear surface of the electric motor 26. The heat shield portion 120 assists in the distribution of cool air over the entire area of the electric motor 26.

Airflow B exits from the space between the heat shield portion 120 and the electric motor 26 around the lower circumference of the heat shield portion 120. Airflow B provides a cooling effect to the electric motor 26, thereby improving its efficiency and enhancing the life of internal bearings.

An outermost portion 124 of the deflector portion 122 is preferably angled toward the fan bracket 34 to enhance the turning action of the exiting airflow A. In the embodiment illustrated in the figures, the angled portion 124 preferably spans the arcuate distance between legs 36 and 38 of the fan bracket 34. Wings 126,128 provided on the angled portion 124 and side walls 130,132,134 provided on the deflector portion 122 and the heat shield portion 120 enhance the flow of airflow across the electric motor 26 by forming an air channel C with the cover plate 100.

The cover plate 100 is formed from any suitable material able to withstand the airflow pressure range and the temperature range of the engine compartment. Aluminized steel is one example of a material suitable for the present cover plate 100. A reinforcing rib 136 formed around the outline of the cover plate 100 can be provided for strength.

While the cover plate 100 of the figures is illustrated as a integral member, it is appreciated that a deflector portion 122 can be formed separately from a heat shield portion 120 and then mounted in an engine compartment to perform the functions described above.

Although the present invention has been described with reference to a preferred embodiment, workers skilled in the art will recognize that changes may be made in form and detail without departing from the spirit and scope of the invention.

The embodiments of the invention in which an exclusive property or privilege is claimed are defined as follows:

1. An assembly for cooling a vehicular engine compartment, comprising:

(a) a fan;

(b) a motor for rotating the fan;

(c) bracket means downstream of the fan for mounting the motor; and (d) cover plate means to form heat shield means spaced from the motor having an air channel and deflector means for directing exiting airflow from the fan to the air channel.

2. The assembly as specified in claim 1 wherein the deflector means includes a portion angled toward the bracket means.

3. The assembly as specified in claim 1 including means for mounting the cover plate means to the bracket means.

4. The assembly as specified in claim 1 wherein the cover plate means is formed from a heat resistive material.

5. The assembly as specified in claim 1 wherein the heat shield means and the deflector means are integrally formed.

6. The assembly as specified in claim 1 wherein the deflector means includes wall means projecting toward the bracket means.

7. The assembly as specified in claim 2 wherein the angled portion includes wing means projecting toward the bracket means.

8. The assembly as specified in claim 1 wherein:

(a) the bracket means includes at least two accurately spaced legs; and (b) the deflector means spans the distance between the legs.

9. The assembly as specified in claim 1 including a shroud for mounting the bracket means and directing air to the fan.

10. The assembly as specified in claim 1 including a rotating shroud attached to the fan.

11. The assembly as specified in claim 1 wherein the motor is an electric motor.

12. A cover plate for an engine cooling fan assembly having a motor supported on a bracket for rotating an axial fan, the cover plate comprising:

(a) heat shield means for preventing radiant heat from reaching the motor; and (b) deflector means for directing exiting airflow from the fan to the motor for cooling the motor.

13. The cover plate specified in claim 12 wherein:

(a) the heat shield means has a diameter substantially equal to the fan motor; and (b) the deflector means extends beyond the fan motor to receive and deflect exiting airflow.

14. The assembly as specified in claim 12 wherein the deflector means includes a portion angled toward the bracket.

15. The assembly as specified in claim 12 wherein the heat shield means and the deflector means are integrally formed.

16. The assembly as specified in claim 12 including means for mounting the cover plate to the bracket.

17. The assembly as specified in claim 12 wherein the deflector means includes wall means projecting toward the bracket means.

18. The assembly as specified in claim 14 wherein the angled portion includes wing means projecting toward the bracket means.

19. The assembly as specified in claim 12 wherein the heat shield means is laterally spaced from the motor.

20. The assembly as specified in claim 12 wherein the heat shield means is formed from a heat resistive material.

* * * * *